US009677366B2

(12) United States Patent
Gendre et al.

(10) Patent No.: US 9,677,366 B2
(45) Date of Patent: Jun. 13, 2017

(54) CONTROL SYSTEM FOR DOWNHOLE CASING MILLING SYSTEM

(71) Applicant: Halliburton Energy Services, Inc., Houston, TX (US)

(72) Inventors: Andrew S. Gendre, Edmonton (CA); Stuart Alexander Telfer, Stonehaven (GB)

(73) Assignee: Halliburton Energy Services, Inc., Houston, TX (US)

( * ) Notice: Subject to any disclaimer, the term of this patent is extended or adjusted under 35 U.S.C. 154(b) by 238 days.

(21) Appl. No.: 14/412,117

(22) PCT Filed: Dec. 31, 2013

(86) PCT No.: PCT/US2013/078468

§ 371 (c)(1),
(2) Date: Dec. 30, 2014

(87) PCT Pub. No.: WO2015/102612

PCT Pub. Date: Jul. 9, 2015

(65) Prior Publication Data

US 2016/0265296 A1 Sep. 15, 2016

(51) Int. Cl.
*E21B 29/06* (2006.01)
*E21B 7/06* (2006.01)
(Continued)

(52) U.S. Cl.
CPC ..... *E21B 29/06* (2013.01); *E21B 7/061* (2013.01); *E21B 47/09* (2013.01); *E21B 7/04* (2013.01)

(58) Field of Classification Search
CPC ..... E21B 29/002; E21B 29/005; E21B 29/06; E21B 47/09; E21B 7/061; E21B 7/04
See application file for complete search history.

(56) References Cited

U.S. PATENT DOCUMENTS 5,103,921 A * 4/1992 Zeer ..... E21B 4/16 175/230
5,778,980 A 7/1998 Comeau et al.
(Continued)

OTHER PUBLICATIONS

International Search Report and the Written Opinion of the International Searching Authority, or the Declaration, Sep. 25, 2014, PCT/US2013/078468, 11 pages, International Searching Authority, KR.

*Primary Examiner* — Brad Harcourt
(74) *Attorney, Agent, or Firm* — Haynes and Boone, LLP

(57) ABSTRACT

A system and method for milling a casing in a wellbore wherein an upper milling portion of a milling system engages a track of a lower guide system of the milling system in order to orient the upper milling portion. The upper milling portion moves along a track from a first position to a second position, where the the upper milling portion is securedly affixed to the lower guide portion. A traveling guide arm is used to move the milling portion along a travel path. A piston on the traveling guide arm is disposed between first and second fluid chambers, with a throughbore in the piston forming a fluid path between the two chambers. An adjustable valve in the throughbore is controlled by a proximity sensor to alter the flow of fluid between the chambers. The sensor monitors the distance between a fixed and moving point of the milling system.

22 Claims, 6 Drawing Sheets

(51) Int. Cl.
*E21B 47/09* (2012.01)
*E21B 7/04* (2006.01)

(56) References Cited

U.S. PATENT DOCUMENTS

| | | | |
|---|---|---|---|
| 5,954,130 | A | 9/1999 | White et al. |
| 6,070,677 | A | 6/2000 | Johnston, Jr. |
| 6,474,415 | B1 | 11/2002 | Ohmer |
| 6,755,248 | B2 | 6/2004 | Toulouse et al. |
| 7,562,700 | B2 | 7/2009 | Lewis et al. |

* cited by examiner

CONTROL SYSTEM FOR DOWNHOLE CASING MILLING SYSTEM

The present application is a U.S. National Stage patent application of International Patent Application No. PCT/US2013/078468, filed on Dec. 31, 2013, the benefit of which is claimed and the disclosure of which is incorporated herein by reference in its entirety.

FIELD OF THE INVENTION

The disclosure relates broadly to a system for downhole milling of a window opening in wellbore casing, and more particularly to a downhole milling system that controls weight on the mill, particularly under heave conditions.

BACKGROUND

It is well known in the art of drilling subterranean wells to form a parent wellbore into the earth and then to form one or more wellbores extending laterally therefrom. Generally, the parent wellbore is first cased and cemented, and then a guiding tool is positioned in the parent wellbore atop an anchor structure locked into place in the parent wellbore casing. The guiding tool includes a sloped surface disposed to guide a cutting mill lowered into the wellbore. More particularly, the tool, often referred to as a whipstock, deflects the cutting mill so that a blade of the cutting mill engages the casing, thereby permitting a window to be milled in the casing and cement. Milling the side wall window in the parent wellbore casing facilitates the subsequent addition of a lateral wellbore thereto. Directional drilling techniques may then be employed to direct further drilling of the lateral bore through the milled window as desired.

The lateral bore is then cased by inserting a tubular liner from the parent bore, through the window previously cut in the parent bore casing and cement, and then into the lateral bore. In a typical lateral bore casing operation, the liner extends somewhat upwardly into the parent bore casing and through the window when the casing operation is finished. In this way, an overlap is achieved wherein the lateral bore liner is received in the parent bore casing above the window.

In some milling system, rather than a whipstock, a mandrel having guide surface may be employed to urge the mill blade into contact with the casing. Thus, a milling system may generally include a mandrel that carries a cutting mill with carriage mounts disposed on either side of the cutting mill. A tubular mill housing has a mill housing opening that forms elongated tracks thereon. Each track has a sloped section and an elongated flat section that extends along a substantial portion of the length of the mill housing. During cutting, the mandrel is moved relative to the mill housing. Specifically, the carriage mounts slide along elongated the tracks. The sloped part of the tracks allows the cutting mill to progressively engage the casing to begin a cut. Once the casing is engaged and an initial hole is milled, the cutting mill is moved along the elongated flat section of the ramp, thereby milling an elongated window in the casing. The cutting mill inner diameter (ID) access dimensions are limited by the dimensions of the mill housing. The current system is limited in this way due to a throat at the top of the mill housing which limits the maximum mill driveshaft diameter and the fixed mill guide limits the maximum diameter of the mill blade and driveshaft.

Each of these structures, however, has one or more disadvantages which make its use inconvenient or uneconomical. Some of these disadvantages include inaccurate positioning and orienting of the window opening to be cut, complexity in setting and releasing the mill, undesirable torque-created rotational shifting of the mill, and the inability to control the effects of weigh on the mill, particularly in offshore environments where heave can quickly alter the weight on the mill, leading to damage of the mill.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. The drawing in which an element first appears is generally indicated by the left-most digit in the corresponding reference number.

DETAILED DESCRIPTION OF THE INVENTION

Figure 1:
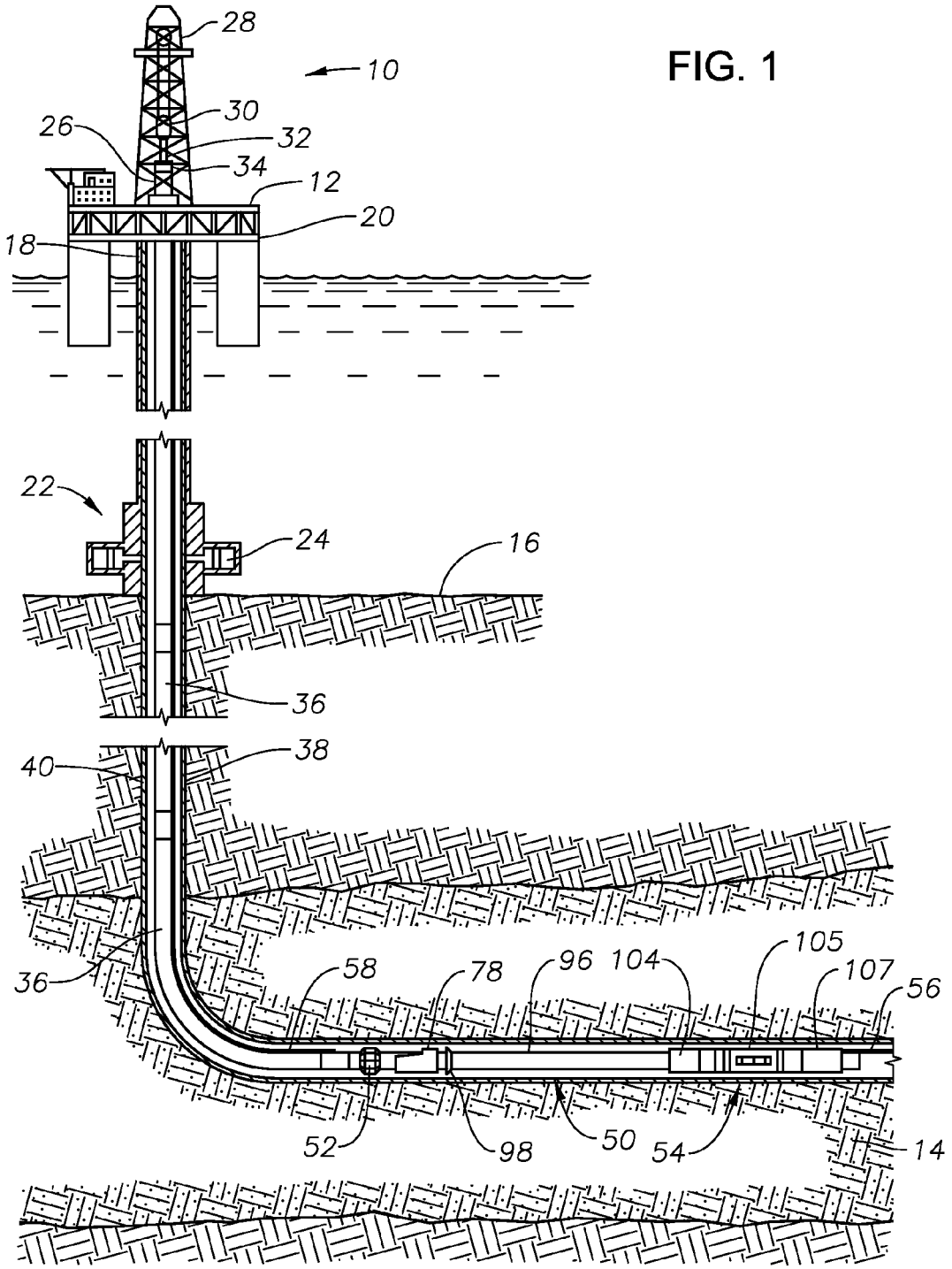
FIG. 1 is a schematic illustration of an oil and gas platform having a milling assembly disposed in a wellbore according to an embodiment of the present disclosure.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the FIGS. The spatially relative terms are intended to encompass different orientations of the apparatus in use or operation in addition to the orientation depicted in the FIGS. For example, if the apparatus in the FIGS. is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Referring initially to FIG. 1, a casing milling assembly is disposed within a wellbore drilled from an offshore oil and gas platform that is schematically illustrated and generally designated 10. A semi-submersible platform 12 is positioned over submerged oil and gas formation 14 located below sea floor 16. A subsea conduit 18 extends from deck 20 of platform 12 to a subsea wellhead installation 22, which may include blowout preventers 24. Platform 12 generally may include a hoisting apparatus 26, a derrick 28, a travel block 30, a hook 32 and a swivel 34 for raising and lowering pipe strings, such as a substantially tubular, axially extending tubing string 36.

A wellbore 38 extends through the various earth strata including formation 14 and has a casing string 40 cemented therein. Disposed in a portion of wellbore 38 is a milling system 50 generally having an upper mill portion 52 and a lower guide system 54.

Extending downhole from lower guide system 54 is one or more communication cables such as electric cable 56 operably associated with one or more electrical devices associated with downhole controllers or actuators used to operate downhole tools or directly with downhole tools such as fluid flow control devices. Electric cable 56 may operate as communication media to transmit power, data and the like between lower guide system 54 and the electrical devices associated with another downhole device (not shown).

Extending uphole from upper milling portion 52 are one or more communication cables such as electric cable 58 that extends to the surface in the annulus between tubing string 36 and casing 40. Electric cable 58 may operate as a communication media to transmit power, data and the like between a surface controller (not pictured) and upper milling portion 52.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Also, even though FIG. 1 depicts an offshore operation, it should be understood by those skilled in the art that the apparatus according to the present disclosure is equally well suited for use in onshore operations. Further, even though FIG. 1 depicts a cased hole, it should be understood by those skilled in the art that the apparatus according to the present disclosure is equally well suited for use in open hole milling systems.

Figure 2:
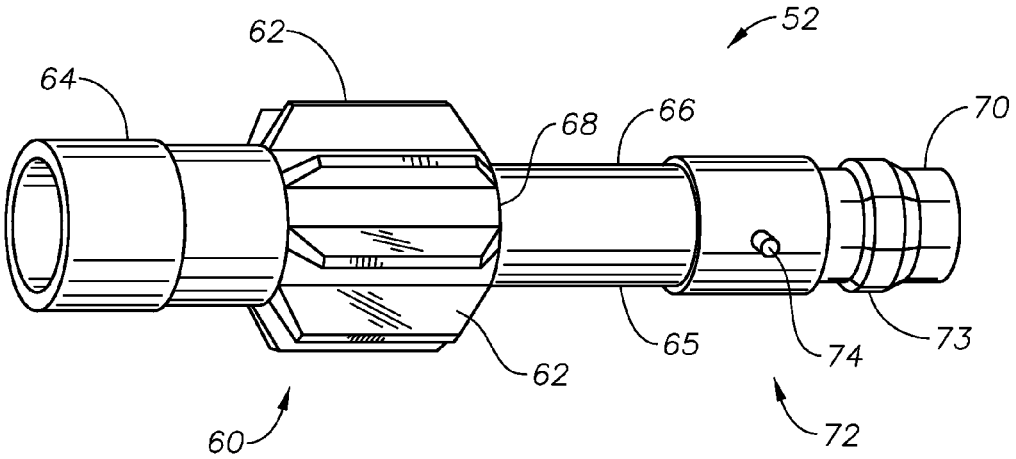
FIG. 2 is a schematic illustration of the upper milling portion of the milling assembly of FIG. 1 according to an embodiment of the present disclosure.

Referring next to FIG. 2, therein is depicted the upper milling portion 52 in greater detail. Upper milling portion 52 includes a mill 60 that has one or more cutting elements or blades 62. The disclosure is not limited to a type of cutting element, and may include multiple cutting elements. Cutting element 62 is carried on a rotatable shaft or tubing 64. Tubing 64 provides rotational force to cutting element 62. Likewise, cutting element 62 provides axial translation force to cutting element 62. When rotated, cutting elements 62 are disposed to mill an opening (not shown) in wellbore casing (such as shown in FIG. 1). Moreover, while rotating, upon axial translation of cutting element 62 relative to a portion of the wellbore casing, an elongated window (not shown) may be formed as is well known in the art.

Extending downhole from mill 60 is an engagement arm 65. Engagement arm 65 is secured to mill 60 at a proximal end 66 and is disposed to be rotatively decoupled from mill 60. In some embodiments, therefore, a bearing 68 may couple arm 65 and mill 60, thereby permitting relative rotation there between. At a distal end 70 of engagement arm 65 is an orientation and locking mechanism 72. In some embodiments, orientation and locking mechanism 72 may include a locking collet 73 and a guide mechanism 74, such as a radially extending guide pin. Although orientation and locking mechanism 74 is depicted as a collet and pin, orientation and locking mechanism 74 may be any device that maintains the orientation of mill 60 and locks upper milling portion 52 to lower guide system 54, as described below.

In some embodiments, wherein guide mechanism 74 is a radially extending pin, the pin may be spring loaded. Alternatively or in addition thereto, the pin may be a rupture or shear pin. In some embodiments, the pin may have a first radially extending position when collet 73 is in a first position and a second radially extending position, when collet 73 is in a second position.

In the second position, collet 73 may move relative to the position of pin 74 along tubing 64, forcing pin 74 outward from the first position to the second position.

Figure 3:
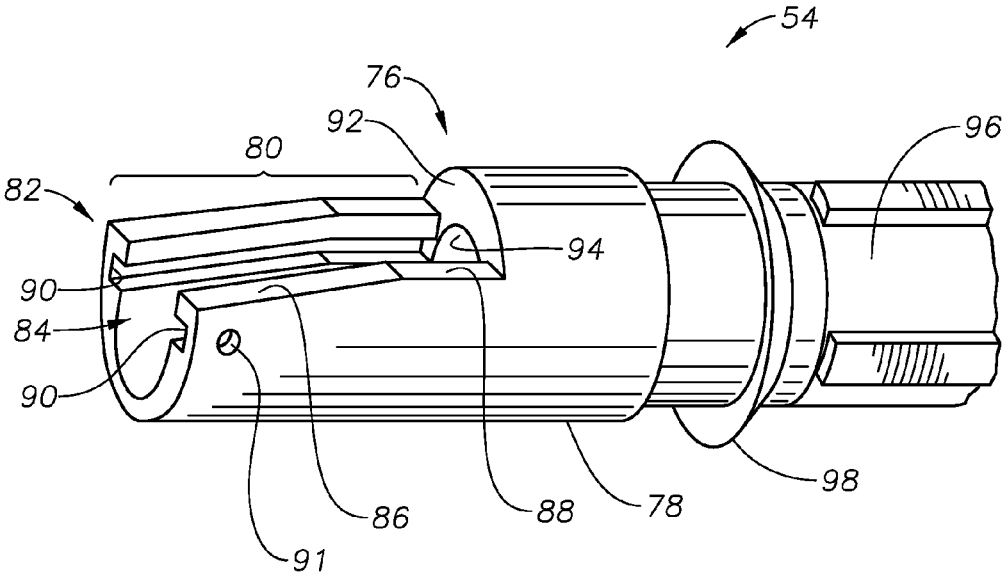
FIG. 3 is a schematic illustration of the lower guide system of the milling assembly of FIG. 1 according to an embodiment of the present disclosure.

FIG. 3 depicts the proximal end 76 of lower guide system 54 in greater detail. Proximal end 76 includes a tubular mill housing 78. An opening 80 is formed in a portion of tubular mill housing 78. A track 82 is formed along the length of the opening 80. Track 82 has a "sloped" section 86 that is sloped relative to the axis of lower guide system 54 and a "flat" section 88 that is substantially parallel with the axis of lower guide system 54. In some embodiments the track 82 may be formed by the edges of housing 78 defining opening 80. In other embodiments, track 82 may be one or grooves or other guide way 90 formed in the side wall of housing 78. In one embodiment, track 82 is formed of grooves or guideways in opposing side walls and takes the shape of u-shaped channels. In any event, the track 82 is disposed to receive guide mechanism 74 of upper milling portion 52. For example, where guide mechanism 74 is a radially extending pin, the pin is disposed to seat within and slide along the track.

To the extent track 82 is a guide way 90, the guide way 90 is open at the end of tubular housing 78 as shown. In some embodiments where guide way 90 is one or more grooves in the sidewall of tubular mill housing 78, at the open end, the inner surface of guide way(s) 90 may be inwardly chamfered or sloped so as to engage a spring loaded pin(s) 74 and force pin(s) 74 radially inward as the pin(s) 74 moves along the guide way(s) 90. Similarly, one or more radially extending apertures 91 may be formed in the sidewall of housing 78 along the inner surface of guide way 90 for receipt of a guide mechanism 74, such as a spring loaded, radially extending pin.

A shoulder 92 is defined along track 82. In some embodiments, shoulder 92 is an edge of housing 78 defining opening 80 and is disposed adjacent one end of track 82. An aperture 94 may be formed in shoulder 92. In some embodiments, aperture 94 is axially offset from the primary axis of lower guide system 54.

Tubular mill housing 78 is carried at one end of an elongated, traveling guide arm 96. In some embodiments, lower guide system 54 may include a debris barrier 98. In some embodiments, debris barrier 98 may be positioned adjacent to or in proximity to housing 78.

Figure 4A:
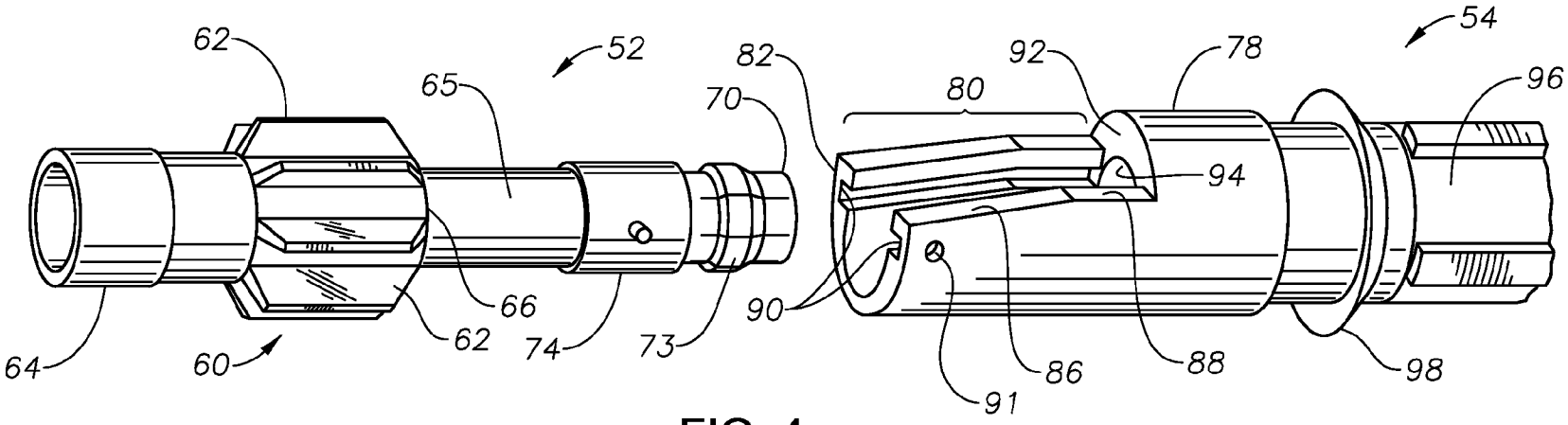
FIGS. 4*a* and 4*b* are schematic illustrations of the upper milling portion of the milling assembly of FIG. 1 engaging the lower guide system according to an embodiment of the present disclosure.
Figure 4B:
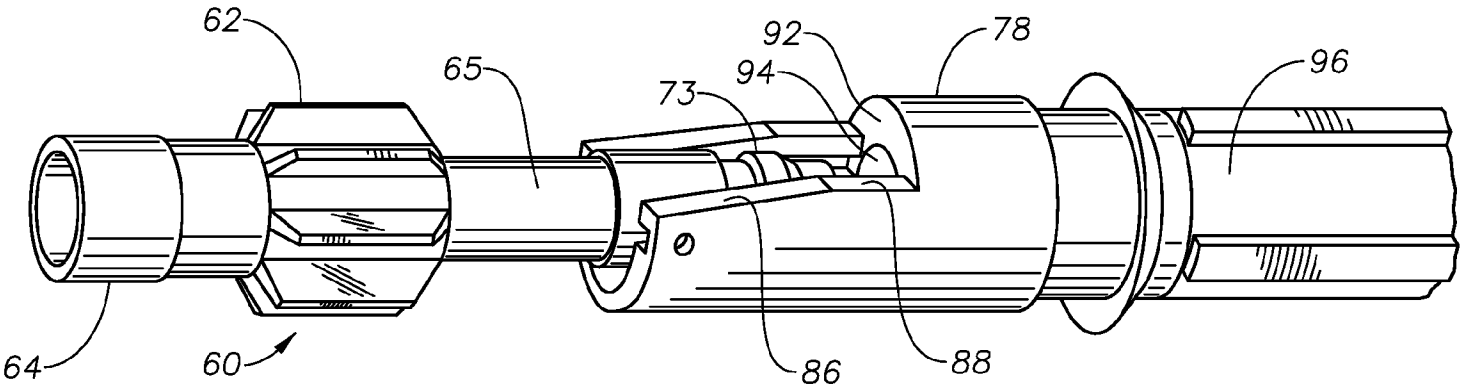

Turning to FIGS. 4*a* and 4*b*, upper mill portion 52 is illustrated in alignment with lower guide system 54 (FIG. 4*a*) and in engagement with lower guide system 54 (FIG. 4*b*). In FIG. 4*a*, guide mechanism 74 of upper mill portion 52 is aligned with track 82 of lower guide system 54. In some embodiments, to the extent guide mechanism 74 are radially extending pins, the pins align with guide ways 90. In some embodiments, when so aligned, upper mill portion 52 and the lower guide system 54 are axially aligned. In any event, once aligned, further axial movement of upper mill portion 52 relative to lower guide system 54 causes guide mechanism 74 to engage track 82 and thereafter, follow track 82 upon continued axial movement, as illustrated in FIG. 4*b*.

Figure 5:
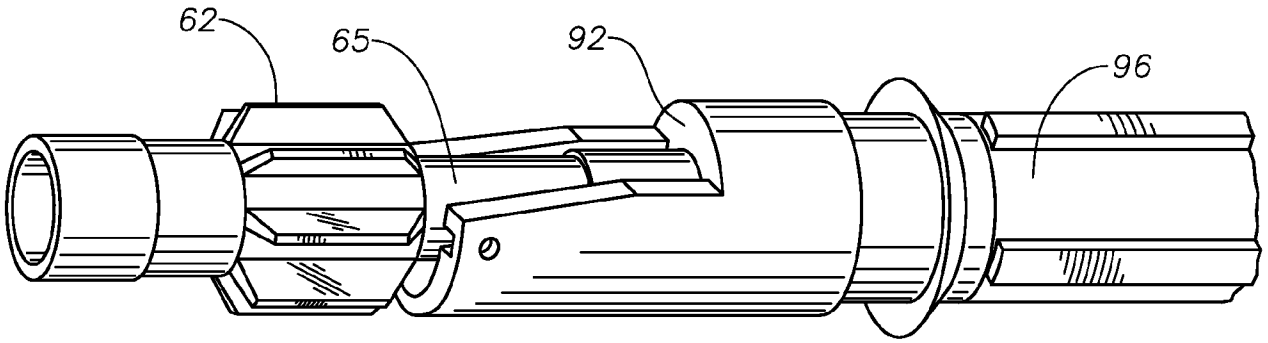
FIG. 5 is a schematic illustration of the upper milling portion of the milling assembly of FIG. 1 fully engaged by the lower guide system according to an embodiment of the present disclosure.

With reference to FIG. 5 and on-going reference to FIG. 4*b*, it will be appreciated that as guide mechanism 74 moves along track 82, upper mill portion 52 will become axially offset from lower guide system 54. Moreover, once guide mechanism 74 has transitioned from the first section 86 of track 82 to the second section 88 of track 82, cutting element(s) 62 will be at its outermost radial position and ready to begin milling of a window (not shown).

Furthermore, to ensure that cutting element(s) 62 remains properly oriented during milling operations, upper mill portion 52 is securedly attached to lower guide system 54. Thus, in the event of surge during milling operations or the application of other forces during milling operations, upper mill portion 52 will remain locked to lower guide system 54. In some embodiments, as upper mill portion 52 becomes axially offset from lower guide system 54, collet 73 aligns with aperture 94. In some embodiments, guide mechanism 74 can continue to travel along track 82 until guide mechanism 74 abuts shoulder 92. In some embodiments, guide mechanism 74 can continue to travel along track 82 until collet 73 seats within aperture 94. In some embodiments, guide mechanism 74 can continue to travel along track 82 until guide mechanism 74 engages a feature along the sidewall of tubular mill housing 78, such as aperture 91. Whichever of the foregoing embodiments is employed, upper mill portion 52 is secured to lower guide system 54 for subsequent operations. In FIG. 5, upper mill portion 52 is illustrated as fully engaged to lower guide system 54.

While guide mechanism 74 and track 82 have been described in certain embodiments and represent a follower system with a travel path having a first radial section and a second axial section, it will be appreciated that any type of follower system may be utilized without departing from the disclosure so long as the follower system urges cutting elements 62 in a radial direction and then in an axial direction and thereafter, upper mill portion 52 is secured to lower guide system 54.

Figure 6:
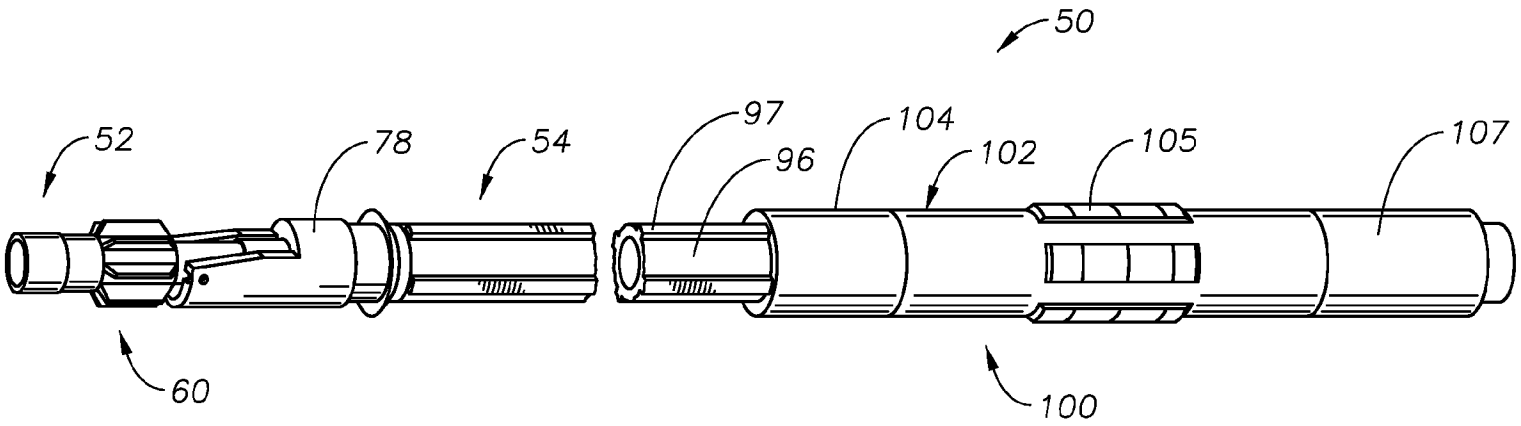
FIG. 6 is a schematic illustration of a milling assembly according to an embodiment of the present disclosure.
Figure 7:
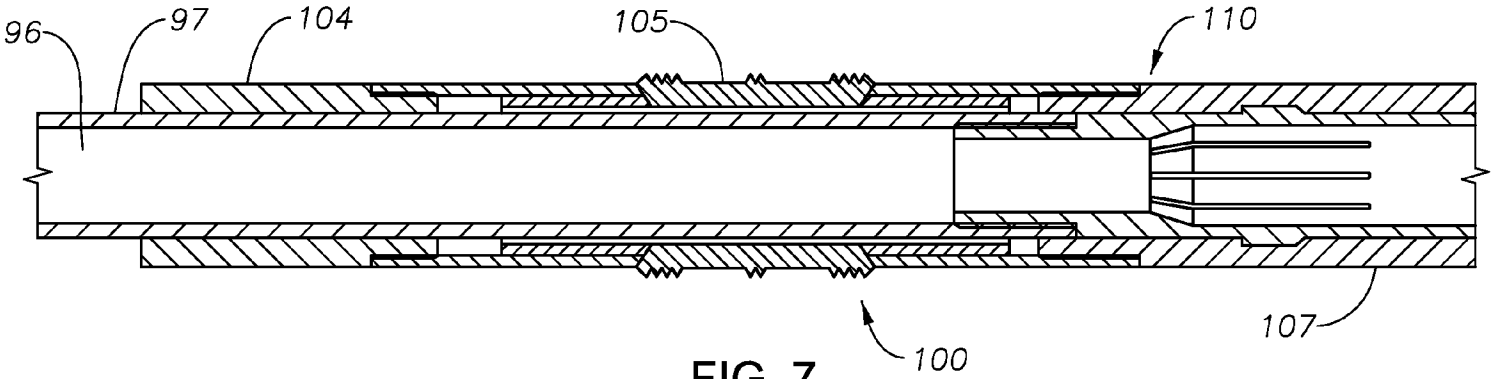
FIG. 7 is a schematic illustration of a cut-away of the latch assembly of the lower guide system according to an embodiment of the present disclosure.

Turning to FIG. 6, milling system 50 is illustrated in greater detail. As shown, upper mill portion 52 is secured to lower guide system 54 as described above. Tubular mill housing 78 is carried at one end of elongated traveling guide arm 96. Elongated traveling guide arm 96 extends from and slidingly engages a guide assembly 100. In some embodiments, elongated guide arm 96 includes one or more splines 97 to prevent relative rotation between traveling guide arm 96 and guide assembly 100. Generally, the elongated traveling guide arm 96 engages guide assembly 100 and is disposed to slide within guide assembly 100 in order to guide the cutting mill 60 along the length of the casing to be milled. As shown in FIGS. 6 and 7, guide assembly 100 generally includes a tubular body 102 which includes a spline section 104 having one or more spline slots 106 disposed to engage the splines 97 of elongated traveling guide arm 96, thereby preventing the guide arm 96 (and hence the cutting mill 60) from rotating during translation. Additionally, guide assembly 100 includes a latch assembly 105 and a cylinder section 107.

Latch assembly 105 may include one or more depth and orientation mechanism 108 for positioning guide assembly 100 in a wellbore casing (not shown) at a predetermined depth and azimuthally orienting guide assembly 100 within the wellbore casing (not shown). Such, depth and orientation mechanism 108 are well known in the art and the disclosure is not limited to any specific configuration. For example, depth and orientation mechanism 108 may include a latch for engagement with a wellbore casing. Specifically, keys on the latch engage pockets in the wellbore casing (not shown) in order to identify a particular depth and orientation. As is well known in the art, once latch assembly 105 is properly positioned as described, guide assembly 100 may thereafter be secured in the wellbore casing with slips or some other setting mechanism (not shown).

Guide assembly 100 may also include a locking mechanism 110 (such as shear pins and/or a collet or other device) to lock guide arm 96 to guide assembly 100 when guide assembly 100 is run into the wellbore. Once guide assembly 100 is positioned in a wellbore casing, the keys engaged and the slips set, locking mechanism 110 can be manipulated to cause traveling guide arm 96 to be disengaged from guide assembly 100 so that guide arm 96 can slide relative to guide assembly 100.

Figure 8:
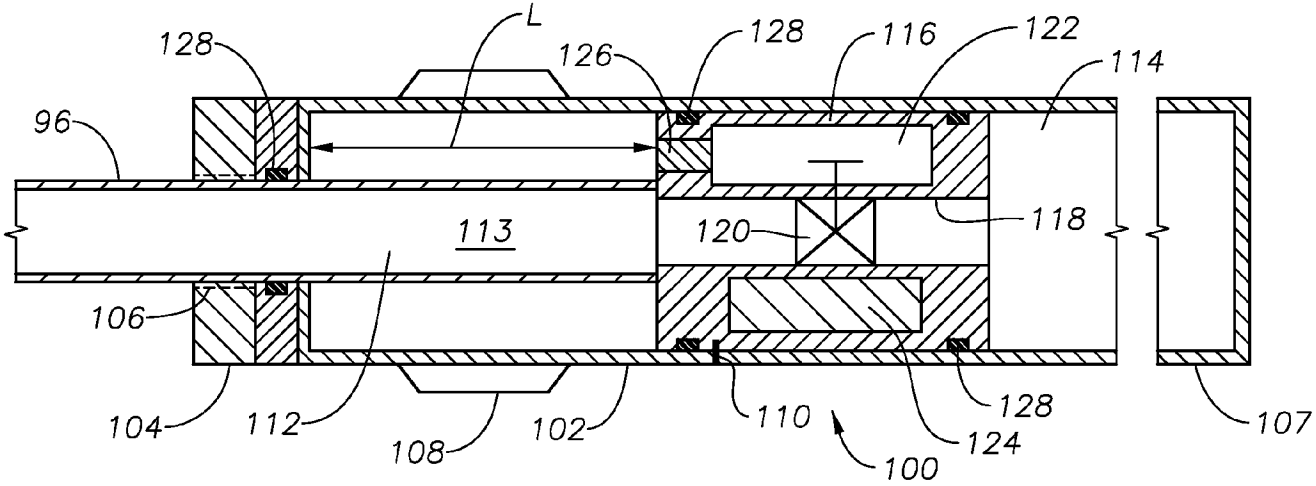
FIG. 8 is a schematic illustration of a cut-away detailed view of the piston and sensor of the lower guide system according to an embodiment of the present disclosure.

With reference to FIG. 8, guide arm 96 and tubular body 102 are illustrated in more detail. As shown, at least a portion of traveling guide arm 96 forms an internal reservoir 112 to define a first fluid chamber. A portion of tubular body 102 forms a cylinder 114 in which is defined a second fluid chamber. Piston 116 attached to the end of guide arm 96 and is slidingly disposed in cylinder 114 between the first and second fluid chambers. A fluid 113 is disposed is each of the fluid chambers, namely the reservoir 112 and cylinder 114. Piston 116 includes a through-bore 118 permitting fluid communication between the fluid chambers, i.e., reservoir 112 and cylinder 114. A release valve 120 is disposed in the through-bore 118 to control the flow of fluid 113 between the first and second fluid chambers, i.e., reservoir 112 and cylinder 114. Release valve 120 may be controlled by a control system 122. A power system 124 may be provided to provide power to control system 122. While control system 122 and power system 124 in one or more embodiments may be locally integrated as part of piston 116, they need not be. Power and/or control can be remote from piston 116. Local power systems may be batteries, capacitors or the like. The actuation medium for release valve 120 is also not limited. In some embodiments, release valve 120 may be actuated hydraulically or electrically utilizing power system 124. In any event, the foregoing arrangement provides a hydraulic bleed system to control movement of mill 60.

A sensor 126 is disposed to provide a measurement to control system 122. In some embodiments, sensor 126 is a position sensor disposed to measure the distance between a fixed point in the wellbore and moving component of milling system 50. In some embodiments, sensor 126 is a position sensor disposed to measure the distance L between the piston 116 and a fixed reference point R on tubular body 102. It will be appreciated that the reference point R is fixed relative to the movement of the sensor 126, which may be carried on piston 126, arm 96 or another portion upper milling portion 52. Alternatively, the sensor may be in a fixed position, such as mounted to guide assembly 100 (which is rigidly secured to the casing string), and may be used to monitor a reference point R selecting on a moving component of the milling system. In any event, sensor 126, in conjunction with control system 122, monitors the position of mill 60 relative to a reference point and can control valve 120 in order to create more intelligent control of the mill 60 during heave events. While sensor 126 is described as being carried by piston 116 in some embodiments, it will be appreciated that sensor 126 may be disposed anywhere in the milling system 50 so long as it can be used to monitor the position of mill 60 relative to a reference point as described.

Seals 128 may be provided to seal between sliding surfaces in a manner well known in the art.

During milling operations, lower guide system 54 is run into a cased wellbore such as is illustrated in FIG. 1. As described above, the guide assembly 100 of lower guide system 54 is fixed in the casing utilizing the depth and orientation mechanism 108 to position guide assembly 100 at a desired depth for milling a casing window. Once positioned and secured in place, locking mechanism 110 is activated to cause a release of guide arm 96 from guide assembly 100, thereby permitting guide arm 96 to move relative to guide assembly 100. In some embodiments, locking mechanism 110 is a shear pin, in which case, an axial force is applied to guide arm 96 in order to shear locking mechanism 110. In some embodiments, the axial force may be applied by upper milling portion 52. In other embodiments, the axial force may be applied before upper milling portion 52 is run into the wellbore. In some embodiments where the axial force is applied utilizing the upper milling portion 52, the axial force may be applied prior to engaging the cutting element 62 with the wellbore casing, while in other embodiments, the axial force may be applied once actual milling of a window has begun.

In any event, once lower guide system 54 is positioned, upper milling portion 52 engages lower guide system 54. Specifically, upper milling portion 52 is run into the wellbore casing and positioned adjacent to lower guide system 54. When positioned adjacent one another, orientation and locking mechanism 72 of upper milling portion 52 is caused to engage tubular mill housing 78. More specifically, orientation and locking mechanism 72 engages track 82 of lower guide system 54. In some embodiments, a guide mechanism 74 engages track 82. In some embodiments, guide mechanism 74 are radially extending pins positioned on opposing sides of engagement arm 65, and are caused to seat in guideways 90 formed in opposing side walls of housing 78.

Thus, it will be appreciated that guide mechanism 74, by engaging track 82, orients mill 60 and in particular, cutting elements 62, and positions cutting elements 62 for a milling operation.

Once orientation and locking mechanism 72 has engaged track 82, mill 60 is activated. In some embodiments, mill 60 is activated by rotting shaft 64, thereby causing cutting elements 62 to rotate. In other embodiments, mill 60 is activated by utilizing other types of drive mechanisms known in the art in order to motivate cutting elements 62. With cutting elements 62 rotating, downward axial movement is applied to upper milling portion 52, thereby causing orientation and locking mechanism 72 to move along track 82 from a first position along the sloped section 86 of track 82 to a second position adjacent the end of housing 78 to a second position along the flat section 88 of track 82. As mill 60 moves from the first position to the second position, cutting element 62 begins to cut the adjacent wellbore casing, forming an initial opening in the casing. In some embodiments, downward relative movement of upper milling portion 52 is continued until upper mill portion 52 is securedly engaged to lower guide system 54. As mill 60 moves from the first position to the second position, upper mill portion 52 becomes axially offset from lower guide system 54. As this occurs, collet 73 aligns with aperture 94. In some embodiments, guide mechanism 74 can continue to travel along track 82 until guide mechanism 74 abuts shoulder 92. In some embodiments, guide mechanism 74 can continue to travel along track 82 until collet 73 seats within aperture 94. In some embodiments, guide mechanism 74 can continue to travel along track 82 until guide mechanism 74 engages a feature along the sidewall of tubular mill housing 78, such as aperture 91. Whichever of the foregoing embodiments is employed, upper mill portion 52 is secured to lower guide system 54 for ongoing milling operations.

It should be noted that in some embodiments, as orientation and locking mechanism 72 is moved along track 82 until upper mill portion 52 is secured to lower guide system 54, locking mechanism 100 continues to retain traveling guide arm 96 locked to guide assembly 100. Once upper mill portion 52 is secured to lower guide system 54 (such as when arm 65 abuts shoulder 94), an axial force may be applied to locking mechanism 110 via upper mill portion 52 in order to release guide arm 96 from guide assembly 100.

In any event, with upper mill portion 52 attached to lower guide system 54 as described, and locking mechanism 110 released, continued downward force on upper mill portion 52 will urge guide arm 96 to slide through guide assembly 100, thus providing a travelling guide for mill 60 (and in contrast to prior art systems that utilize an elongated flat track along which a mill is urged).

Moreover, movement of traveling guide arm 96 through guide assembly 100 can be controlled by piston 116 at the end of traveling guide arm 96. As described, a fluid 113 is disposed within piston 114. As downward pressure is applied to arm 96, pressure on fluid 113 within piston 114 is increased. Valve 120 may be utilized to permit a controlled release of fluid 113 from piston 114, allowing cutting element 62 to be more smoothly moved along the axis of the window to be milled. This allows an increased pressure on upper milling portion 52 to be maintained, thereby minimizing the likelihood that heave will cause cutting element 62 to jump around along the axis of the window to be milled. In some embodiments, the rate of movement of cutting element 62 along the axis of a window to be milled may be further controlled by employing sensor 126. Specifically, sensor 126 may monitor distance L. Control system 122 may use the output from sensor 126 to calculate the rate of movement of piston 116, and hence the rate of movement of mill 60. In this regard, based on a desired rate of movement of mill 60, control system 122 may be utilized to alter fluid 113 flow through valve 120 between first and second fluid chambers respectively formed by cylinder 114 and reservoir 113.

Figure 9:
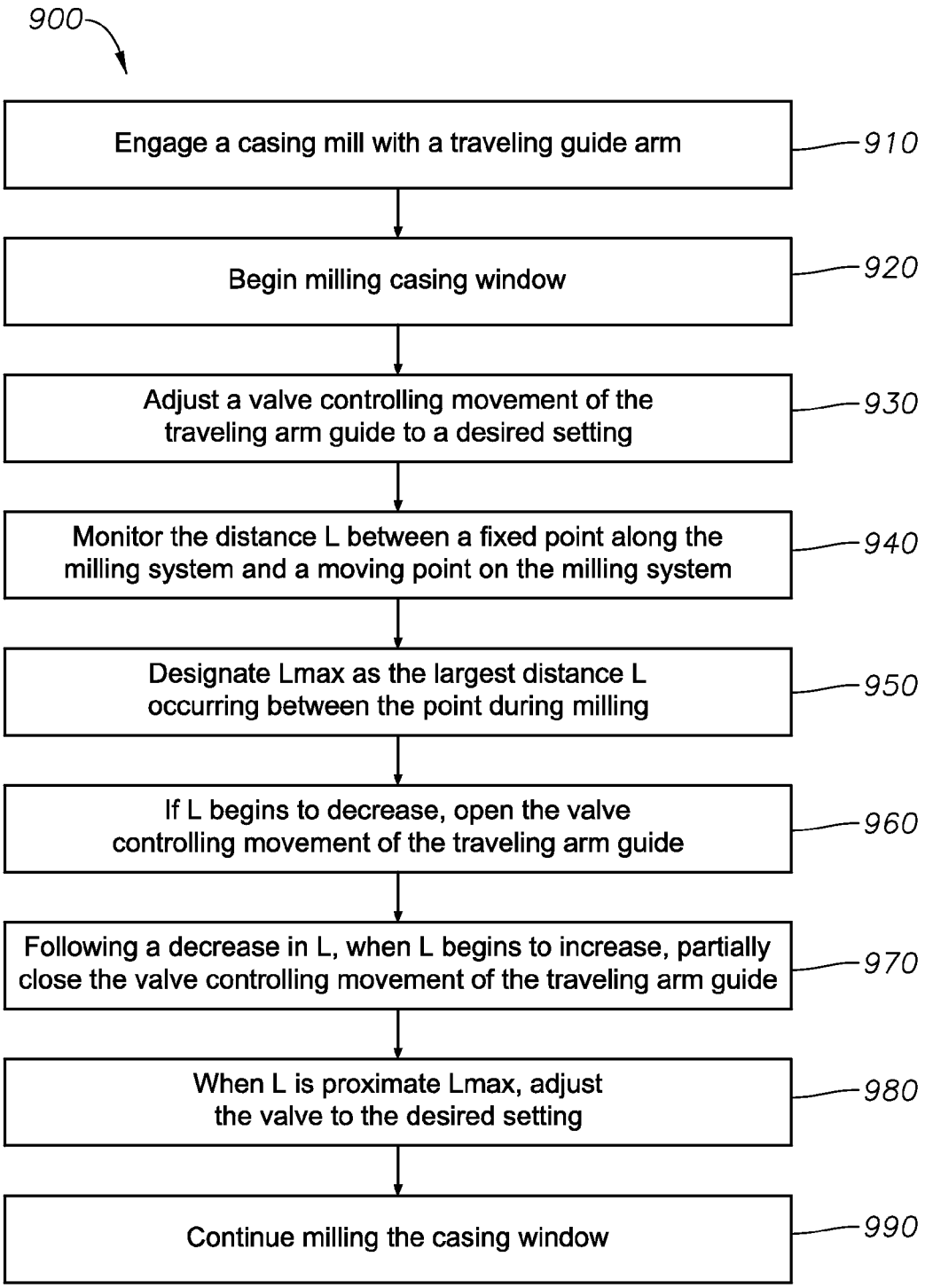
FIG. 9 is a flow chart of a method for milling a wellbore casing according to an embodiment of the present disclosure.

In FIG. 9, the operation of the control system 112 of a milling system is illustrated. The system is utilized to mill one or more windows in the casing of a wellbore. Thus, a primary wellbore is drilled and casing is cemented in place within the wellbore. With the casing cemented in placed, the guide system of a milling system is run-in the wellbore and latched into place along the casing string in proximity to a portion of the casing string to be milled.

With the guide system latched into place, a traveling guide arm may be released from the latch assembly of the lower guide system. In some embodiments, this release may be accomplished by placing a downward force on the traveling guide arm until a shear pin securing the guide arm to the latch assembly is ruptured.

Next, the upper milling portion of the milling system is run-in the wellbore and the casing mill is engages a traveling guide arm of the lower guide assembly, as at step 910. More particularly, a guide mechanism on the upper milling portion is aligned with a track on a housing carried by the traveling guide arm. Once, aligned, the guide mechanism engages the track. On some embodiments, at this point, the cutting blades are activated, such as by rotation of the tubular on which the upper milling portion is conveyed. The guide mechanism is then moved along the track, causing the cutting elements to move into contact with the adjacent casing and begin cutting an opening in the casing, as at 920.

The guide mechanism continues to move along the track to enlarge the opening until the upper milling portion fully engages and locks into the housing carried by the traveling guide arm of the lower guide housing.

With the upper milling portion fully engaged with the lower guide system, the traveling guide arm is activated and begins to move along a linear path, as at 930. While the guide arm is moving along the path, the control system monitors the position of the casing mill and makes adjustments to control the weight-on-mill and the milling rate. In this regard, once the traveling guide arm begins to move, a valve employed to control the rate of cutting is adjusted to a desired setting, as at 930. As milling continues, the distance L between a fixed point and a moving point is monitored, as at step 940. For example, the fixed point may be a reference point on a component of the milling system rigidly secured to the casing and the moving point may be a reference point on a component of the milling system that moves relative to the casing, such as the mill. In some embodiments, the monitoring may be continuous during milling. At step 950, as the current distance L is monitored, the largest distance achieved is recorded as $L_{max}$. This distance $L_{max}$ generally will be continually increasing during normal operations. If the current distance L begins to decrease ($L<L_{max}$), the bleed valve in the piston of the latch assembly described above is opened to allow fluid to flow from the fluid chamber of the cylinder of the latch assembly to the fluid chamber, i.e., the reservoir, of the elongated arm, as at 960. The open valve permits the mill to move upward freely without any hydraulic dampening. For example, the monitored distance is likely to decrease upon a heave event (any event that causes the cutting element to lift away from contacting with the casing), such as the rising of the platform at the surface of the water under wave action. In some embodiments, as monitoring of distance L continues, the minimum distance $L_{min}$ achieved in a heave cycle is recorded. When the distance L between the fixed point and the moving point begins to increase again ($L>L_{min}$), the valve is partially closed to limit the speed of the mill moving back down into contact with the casing, as at 970. At step 980, as the current distance L approaches the maximum achieved distance $L_{max}$, i.e., the mill approaches the furthest down position it had previously reached, the valve is further closed to the restriction it was set at when $L_{max}$ was previously achieved, i.e., the desired setting. Milling is continued at 990 as is the monitoring and control of steps 930-980. In this way, the milling rate can be controlled and a substantially constant weight on mill can be maintained.

Thus, a casing milling system has been described. One advantage of the system is that full inner diameter access may be provided to the mill assembly and drive shaft uphole. This allows the possibly to increase the diameter of the mill (creating a larger first pass window, making a second pass milling easier or eliminating the requirement for second pass altogether). It also allows the drive shaft to be strengthened since the drive shaft does not need to pass through an inner diameter of a mill housing, such as housing 78. Moreover, the system allows for a larger return flow annulus for return cuttings because there is no whipstock. Additionally, in some embodiments, a debris barrier may be incorporated to seal below the location of a window being milled to force cuttings to return uphole. Finally, the system, allowing for a more precise placement of a milled window, may possibly eliminate the need for a second mill pass, significantly reducing rig time.

In addition, in some embodiments, a piston and control system minimize the effects of heave and/or changes in the weight on mill as the milling system moves along a desired cutting path. This provides a hydraulic system with a metering valve which lets pressure bleed out of the cylinder as the mill is pushed down along the cut path. Moreover, in some embodiments, a sensor may be incorporated to monitor the relative distance between a fixed point and a moving component of the milling system and thereby control a bleed valve to minimize the effects of heave on the milling system.

An additional advantage of the forgoing embodiments is that the mill housing is greatly reduced in length, essentially eliminating the elongated flat portion of the track prevalent in prior art milling systems since the cutting mill transitions to a short, flat portion of track and then shoulders out.

Thus, various embodiments of a casing milling system for wellbores have been described. These embodiments of the milling system may generally include a mill portion comprising at least one cutting element, an axially extending engagement arm, and an orientation and locking mechanism on a distal end of engagement arm; and a guide system comprising a tubular mill housing having an opening formed in a portion of tubular mill housing with a track formed along a portion of the length of the opening, an elongated, traveling guide arm extending from the tubular mill housing and defined along an axis, a guide assembly disposed to slidingly receive the traveling guide arm, wherein the guide assembly includes a tubular body, a portion of which defines a cylinder section, and a latch assembly. Likewise, other embodiments of a casing milling system for wellbores have been described. These embodiments of the milling system may generally include a mill comprising at least one cutting element, an axially extending engagement arm, and an orientation and locking mechanism on a distal end of engagement arm; a guide system comprising a tubular mill housing having an opening formed in a portion of tubular mill housing with a track formed along a portion of the length of the opening, an elongated, traveling guide arm extending from the tubular mill housing and defined along an axis, a guide assembly disposed to slidingly receive the traveling guide arm, wherein the guide assembly includes a tubular body, a portion of which defines a cylinder section, and a latch assembly, wherein the traveling guide arm comprises an internal reservoir and a piston attached to an end of the guide arm and disposed to slide within the cylinder section of the tubular body of the guide assembly, wherein the piston includes a through-bore permitting fluid communication between the reservoir and the cylinder and a release valve disposed in the through-bore to control the flow of fluid between the reservoir and the cylinder; and a sensor disposed to measure movement between a first point in the wellbore and a second point in the wellbore.

For any of the foregoing embodiments, the milling systems may include any one of the following elements, alone or in combination with each other:

- A rotatable shaft on which the cutting element is carried.
- A bearing coupling a proximal end of arm to the cutting element, thereby permitting relative rotation there between.

The orientation and locking mechanism comprises a guide mechanism

The guide mechanism is a pin radially extending from the arm.

The guide mechanism is a pin radially extendable from the arm, wherein the pin has a first radially extending position when a collet is in a first position and a second radially extending position when the collet is in a second position.

The guide mechanism is a shear pin.

The orientation and locking mechanism comprises a locking collet.

A locking collet is disposed to seat in an aperture defined in the tubular mill housing so that the mill is axially offset from the elongated guide arm when the collet is seated in the aperture.

The track has a first section that is sloped relative to the axis of the elongated traveling guide arm and a second section that is substantially parallel with the axis of the guide arm.

The track is formed by the edges of the housing opening.

The track has guide way formed in a side wall of the housing

The guide way is a u-shaped channel.

The guide way is open at an end of the tubular housing

The guide way comprises a groove in a side wall of the housing, the groove having an inner surface that is inwardly chamfered along a portion of the guide way.

Radially extending apertures formed in opposing sidewalls of housing.

A shoulder defined along the track.

A shoulder is an edge of the housing opening and is disposed adjacent one end of the track.

An aperture formed in the shoulder.

The aperture is axially offset from the axis of the guide arm.

The elongated, traveling guide arm comprises splines along a portion of the length of the guide arm.

The tubular body of the guide assembly has spline slots disposed to engage splines defined on the traveling guide arm.

The latch assembly comprises a depth and orientation mechanism.

The latch assembly comprises a latch disposed to engage pockets in the wellbore casing The guide assembly comprises a locking mechanism disposed to lock guide arm to the guide assembly.

The locking mechanism of the guide assembly comprises a shear pin.

A debris barrier positioned in proximity to the tubular mill housing.

The track comprises a follower system defining a travel path having a first radial section and a second axial section.

The guide system comprises a first fluid chamber and a second fluid chamber separated by a piston disposed on an end of the elongated guide member.

One fluid chamber is an internal reservoir formed in the traveling guide arm.

One fluid chamber is formed by a portion of the cylinder.

A piston attached to an end of the guide arm and disposed to slide within the cylinder section of the tubular body of the guide assembly.

A fluid disposed in the reservoir and the cylinder.

A piston includes a through-bore permitting fluid communication between a reservoir and a cylinder.

A release valve disposed in the through-bore.

A control system to control operation of a release valve.

A power system to provided power to a control system.

A control system and power system integrated as part of a piston.

The release valve is actuated hydraulically.

The release valve is actuated electrically.

A sensor disposed to measure movement between a first point in the wellbore and a second point in the wellbore.

The first point is defined on the guide assembly and the second point is defined on a portion of the casing milling system movable relative to the guide assembly.

The first point is defined on a fixed portion of the casing milling system and the second point is defined on a portion of the casing milling system movable relative to fixed portion.

A proximity sensor disposed to measure the relative distance between a fixed portion of the casing milling system and the second point is defined on a portion of the casing milling system movable relative to fixed portion.

The proximity sensor is mounted on the piston and disposed to measure relative distance between the piston and the tubular body of the guide assembly.

A method for milling a casing in a wellbore has been described. Embodiments of the milling method may include engaging the track of a guide system of a casing milling system by a mill; moving the mill along the track from a first position to a second position until the mill is secured to the guide system; and moving a guide arm of the guide system and to which the mill is attached through a guide assembly of the guide system in order to control movement of the mill and thereby forming a window in the casing. For any of the foregoing embodiments, the method may include any one of the following steps, alone or in combination with each other:

Running a guide system of a casing milling system into a cased wellbore and latching the guide system to the casing Activating a locking mechanism to release a guide arm of the guide system from a guide assembly, thereby permitting the guide arm to move relative to guide assembly.

Applying an axial force to a shear pin to release a guide arm of the guide system from a guide assembly, thereby permitting the guide arm to move relative to guide assembly.

Positioning a mill adjacent a guide system, and causing an orientation and locking mechanism of the mill to engage a tubular mill housing of the guide system.

Engaging a track of the guide system with the mill.

Seating a guide mechanism of the mill in a guide way of the guide system.

Activating a cutting element of the mill.

Applying downward axial force to the mill to move the mill along the track from a first position along a sloped section of the track to a second position adjacent the end of the guide system housing.

Forming an initial opening in the casing by moving the mill along the track.

Fixing the mill to an end of the guide system.

Causing the mill to become axially offset from the guide system as the mill moves along the track from the first position to the second position.

Engaging an opening in the guide system with a collet of the mill to attach the mill to the guide system.

Moving a guide arm of the guide system and to which the mill is attached through a guide assembly of the guide system.

Controlling movement of the guide arm utilizing a piston at the end of guide arm.

Adjusting a valve in the piston to control fluid flow between a first chamber and a second chamber thereby controlling movement of the guide arm.

Employing a proximity sensor to control the valve adjustment.

Controlling the flow of fluid between a first chamber and a second chamber utilizing a proximity sensor.

Utilizing a proximity sensor to monitor a distance L.

Drilling a wellbore, cementing a casing string in place within the wellbore, running a guide system into the wellbore and latching it in place along the casing string in proximity to a portion of the casing string to be milled.

Adjusting weight-on-mill.

Employing a valve to control the weight-on-mill.

Employing a valve to control the milling rate.

Selecting a fixed point and a moving point and monitoring the distance between the two points.

Adjusting the valve based on the monitored distance.

If a monitored distance begins to decrease, opening the valve from a first position to a second position to allow fluid to flow from a reservoir in the cylinder to a reservoir in the elongated arm.

Once the valve has been opened, continuing to monitor the distance and when the monitored distance begins to increase, at least partially closing the valve from the second position to a third position between the first and second positions.

Once the valve has been partially closed, continuing to monitor the distance and when the monitored distance approaches a previous maximum distance, adjusting the valve to close it from the second position to a fourth position.

The fourth position is the same as the first position.

Although various embodiments and methods have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

The invention claimed is:

1. A casing milling system for wellbores, the milling system comprising:

a mill portion comprising at least one cutting element, an axially extending engagement arm, and an orientation and locking mechanism on a distal end of engagement arm; and a guide system comprising a tubular mill housing having an opening formed in a portion of tubular mill housing with a track formed along a portion of the length of the opening, an elongated, traveling guide arm extending from the tubular mill housing and defined along an axis, a guide assembly disposed to slidingly receive the traveling guide arm, wherein the guide assembly includes a tubular body, a portion of which defines a cylinder section, and a latch assembly.

2. The milling system of claim 1, wherein the orientation and locking mechanism comprises a locking collet and the tubular mill housing includes a shoulder with an opening disposed therein for receipt of the locking collet.

3. The milling system of claim 1, wherein the orientation and locking mechanism comprises a guide mechanism.

4. The milling system 3, wherein the guide mechanism comprises a pin radially extending from the arm.

5. The milling system of claim 1, wherein the track has a first section that is sloped relative to the axis of the elongated traveling guide arm and a second section that is substantially parallel with the axis of the guide arm.

6. The milling system of claim 5, wherein the track comprises a guide way formed in a side wall of the housing.

7. The milling system of claim 6, wherein the guide way is open at an end of the tubular housing.

8. The milling system of claim 1, further comprising a debris barrier positioned in proximity to the tubular mill housing.

9. The milling system of claim 1, wherein the traveling guide arm comprises an internal reservoir and a piston attached to an end of the guide arm and disposed to slide within the cylinder section of the tubular body of the guide assembly, wherein the piston includes a through-bore permitting fluid communication between the reservoir and the cylinder.

10. The milling system of claim 9, further comprising a release valve disposed in the through-bore to control the flow of fluid between the reservoir and the cylinder.

11. The milling system of claim 1 or 8 or 9 or 10, further comprising a sensor disposed to measure movement between a first point in the wellbore and a second point in the wellbore.

12. The milling system of claim 1 or 8 or 9 or 10, further comprising a proximity sensor disposed to measure the relative distance between a fixed portion of the casing milling system and the second point is defined on a portion of the casing milling system movable relative to fixed portion.

13. A casing milling system for wellbores, the milling system comprising:

a mill comprising at least one cutting element, an axially extending engagement arm, and an orientation and locking mechanism on a distal end of engagement arm;

a guide system comprising a tubular mill housing having an opening formed in a portion of tubular mill housing with a track formed along a portion of the length of the opening, an elongated, traveling guide arm extending from the tubular mill housing and defined along an axis, a guide assembly disposed to slidingly receive the traveling guide arm, wherein the guide assembly includes a tubular body, a portion of which defines a cylinder section, and a latch assembly, wherein the traveling guide arm comprises an internal reservoir and a piston attached to an end of the guide arm and disposed to slide within the cylinder section of the tubular body of the guide assembly, wherein the piston includes a through-bore permitting fluid communication between the reservoir and the cylinder and a release valve disposed in the through-bore to control the flow of fluid between the reservoir and the cylinder; and a sensor disposed to measure movement between a first point in the wellbore and a second point in the wellbore.

14. The milling system of claim 13, wherein the track has a first section that is sloped relative to the axis of the elongated traveling guide arm and a second section that is substantially parallel with the axis of the guide arm.

15. The milling system of claim 14, wherein the track comprises a guide way formed in a side wall of the housing, wherein the guide way is open at an end of the tubular housing.

16. A method for milling a casing in a wellbore, the method comprising:

engaging the track of a guide system of a casing milling system by a mill;

moving the mill along the track from a first position to a second position until the mill is secured to the guide system; and moving a guide arm of the guide system and to which the mill is attached through a guide assembly of the guide system in order to control movement of the mill and thereby forming a window in the casing.

17. The method of claim 16, further comprising controlling movement of the guide arm by altering the flow of fluid between a first chamber and a second chamber.

18. The method of claim 17, wherein altering the flow of fluid comprises measuring the change in distance between a first fixed point and a second point in the wellbore and between a first chamber and a second chamber and adjusting a valve positioned between the two chambers.

19. The method of claim 17, further comprising selecting a fixed point and a moving point and monitoring the distance between the two points and adjusting a valve to control the flow of fluid between a first and second chamber based on the monitored distance.

20. The method of claim 19, wherein if a monitored distance begins to decrease, opening the valve from a first position to a second position to allow fluid to flow from a reservoir in the cylinder to a reservoir in the elongated arm.

21. The method of claim 20, wherein once the valve has been opened, continuing to monitor the distance and when the monitored distance begins to increase, at least partially closing the valve from the second position to a third position between the first and second positions.

22. The method of claim 21, wherein once the valve has been partially closed, continuing to monitor the distance and when the monitored distance approaches a previous maximum distance, adjusting the valve to close it from the second position to a fourth position.

* * * * *